United States Patent [19]

Baun

[11] Patent Number: 4,568,026

[45] Date of Patent: Feb. 4, 1986

[54] PILOT OPERATED COOLANT CONTROL VALVES IN MANIFOLD ASSEMBLY

[76] Inventor: Daniel E. Baun, 1902 Massachusetts Ave., Poland, Ohio 44514

[21] Appl. No.: 610,320

[22] Filed: May 14, 1984

[51] Int. Cl.[4] ..... B05B 1/14

[52] U.S. Cl. ..... 239/551; 137/883; 137/884

[58] Field of Search ..... 239/551, 600, 585, 562; 137/883–885; 251/30

[56] References Cited

U.S. PATENT DOCUMENTS

| | | | |
|---|---|---|---|
| 3,145,907 | 8/1964 | Gardner | 251/5 |
| 3,159,374 | 12/1964 | Kroffke | 251/30 |
| 3,880,358 | 4/1975 | Schaming | 239/551 |
| 4,247,047 | 1/1981 | Schaming | 239/551 |
| 4,360,037 | 11/1982 | Kendall | 251/30 |
| 4,387,739 | 6/1983 | Schaming | 137/884 |
| 4,391,296 | 7/1983 | Abbott | 137/523 |
| 4,400,961 | 8/1983 | Schaming | 72/201 |

*Primary Examiner*—Andres Kashnikow
*Assistant Examiner*—Scott D. Malpede
*Attorney, Agent, or Firm*—Harpman & Harpman

[57] ABSTRACT

A plurality of pilot operated coolant control valves are mounted in manifolds which in turn are positioned adjacent the work and backup rolls of a rolling mill and used to supply coolant to said rolls in desirable spray patterns covering the surfaces of the rolls and operable only when the rolling mill is functioning normally.

6 Claims, 7 Drawing Figures

PILOT OPERATED COOLANT CONTROL VALVES IN MANIFOLD ASSEMBLY

BACKGROUND OF THE INVENTION

1. Technical Field

This invention relates to rolling mills in general and more particularly to rolling mills where aluminum is being reduced to thin gauge sheets and still more particularly to coolant applying devices for said rolling mills.

2. Description of the Prior Art

Prior coolant applying devices used on rolling mills have arranged elongated manifolds parallel with the work and backup rolls of the rolling mill and directed fluids, such as kerosene, through individual spray nozzles on the manifolds against the rolls of the mill to provide temperature control and lubrication during the rolling operation. The known prior art patents are U.S. Pat. Nos. 3,880,358, 4,427,047 and 4,400,961.

Several prior art patents relate to pilot operated control valves including U.S. Pat. Nos. 3,145,967, 3,159,374 and 4,391,296. In each of these patents, solenoid operated valves are disclosed which theorectically control fluid directed therethrough.

In U.S. Pat. No. 3,145,967 an elastic sleeve is arranged in spaced relation about a core positioned in a fluid passageway to be controlled. An annular cavity in the valve around the exterior surface of the elastic sleeve enables air pressure to be introduced so as to distort the plastic sleeve inwardly against the core and thus close the fluid passageway. The air pressure is controlled by a solenoid operated valve.

In U.S. Pat. No. 3,159,374, a flexible diaphragm is positioned to intercept a fluid passageway through the valve when fluid pressure is applied to one side of the diaphragm so as to distort the same into closing relation to the fluid passageway controlled thereby. The fluid pressure for operating the diaphragm is controlled by a solenoid valve.

U.S. Pat. No. 4,391,296 discloses a valve in which a valve plug moves into and out of closing relation with respect to a fluid passageway extending between an inlet port and an outlet port with the valve plug being urged to closed position in the fluid passageway by a spring and moved to open position by a solenoid. A piston is positioned in an extension of the fluid passageway and a secondary inlet port is in communication with the fluid passageway below the piston so that manual operation of the valve can be achieved by introducing hydraulic pressure into the second inlet port so as to move the piston in the fluid passageway where it will engage and open the valve plug.

The present invention is dependent upon the positive control of the coolant by each of the plurality of pilot operated valves in the manifold assembly. These valves must shut off instantly, as for example when a flash fire occurs and the continued spraying of the coolant liquid, such as kerosene, would feed the fire and destroy the rolling mill. The prior art pilot operated control valves are unable to effect instantaneous positive shut-off action and are subject to faulty operation due to dirt or particles of foreign materials in the coolant supply.

The prior art coolant control valves generally do not fail safe which is extremely important when the coolant, which is commonly kerosene, is flammable. Generally, the prior art coolant valves require complete dismantling of the valve bodies and the operable parts whereas in the present invention the valve bodies defining the valve seats and the movable valve elements take the form of quickly and easily removable cartridges and due to their novel construction and operating patterns are able to operate successfully and close completely and quickly despite the presence of dirt and/or foreign materials in the coolant supply.

This invention eliminates the problems that heretofore existed in connection with pilot operated coolant control valves arranged in and supplied by manifold asemblies.

SUMMARY OF THE INVENTION

A pilot operated coolant control valve assembly on a coolant control manifold provides a plurality of fail-safe valve elements in removable cartridge-like assemblies controlling the supply of coolant, such as kerosene to individual spray nozzles directed at rolling mill rolls and the like. Each of the multiple coolant control valves is operable to open position by solenoids incorporated therein and operable to closed position by de-energization of the solenoids and the resultant hydraulic actuation of the pilot valve elements by the coolant. Instantaneous shut-down of the coolant spray means is therefore achieved by simple de-energization of the several solenoids controlling the pilot valves, which in turn control the coolant control valves which control the coolant supplied the spray nozzles of the manifold assembly.

DESCRIPTION OF THE PREFERRED EMBODIMENT

Figure 1:
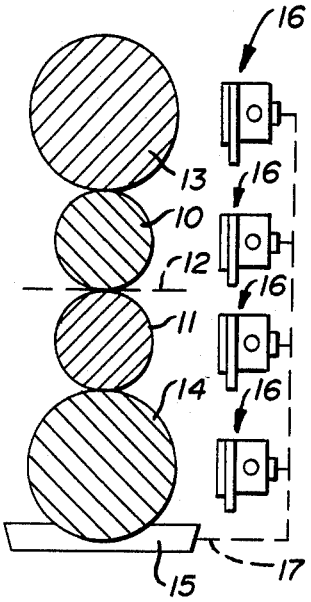
FIG. 1 is a symbolic illustration of a pair of work rolls and associated backup rolls of a rolling mill with a fluid collecting trough therebelow and several fluid spraying manifold assemblies therebeside.

By referring to FIG. 1 of the drawings, it will be seen that a diagrammatic illustration of a rolling mill discloses superimposed work rolls 10 and 11 engaged on a pass line 12 and having backup rolls 13 and 14 as will be understood by those skilled in the art.

Means for driving the rolls is not illustrated. A coolant collection trough 15 is shown and four vertically spaced coolant control valve manifold assemblies 16 are shown positioned in spaced relation to the work rolls 10 and 11 and the backup rolls 13 and 14. Means for circulating a coolant fluid such as kerosene from the collecting trough 15 to the manifold assembly 16 is indicated by broken lines 17.

Figure 2:
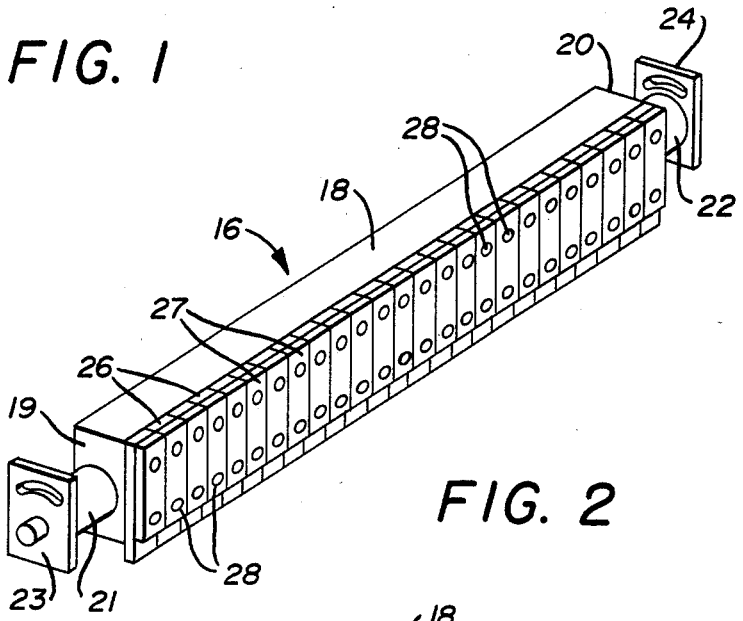
FIG. 2 is a perspective elevation of a plurality of coolant control valves on a manifold assembly.

By referring to FIG. 2 of the drawings, a perspective elevation of one of the coolant control valve manifold assemblies 16 may be seen and it is formed of an elongated housing 18 closed at its ends 19 and 20 and provided with end extensions 21 and 22 including mounting and adjustment plates 23 and 24 by which the housing 18 is supported adjacent a roll of a rolling mill as hereinbefore described in connection with FIG. 1 of the drawings.

Figure 5:
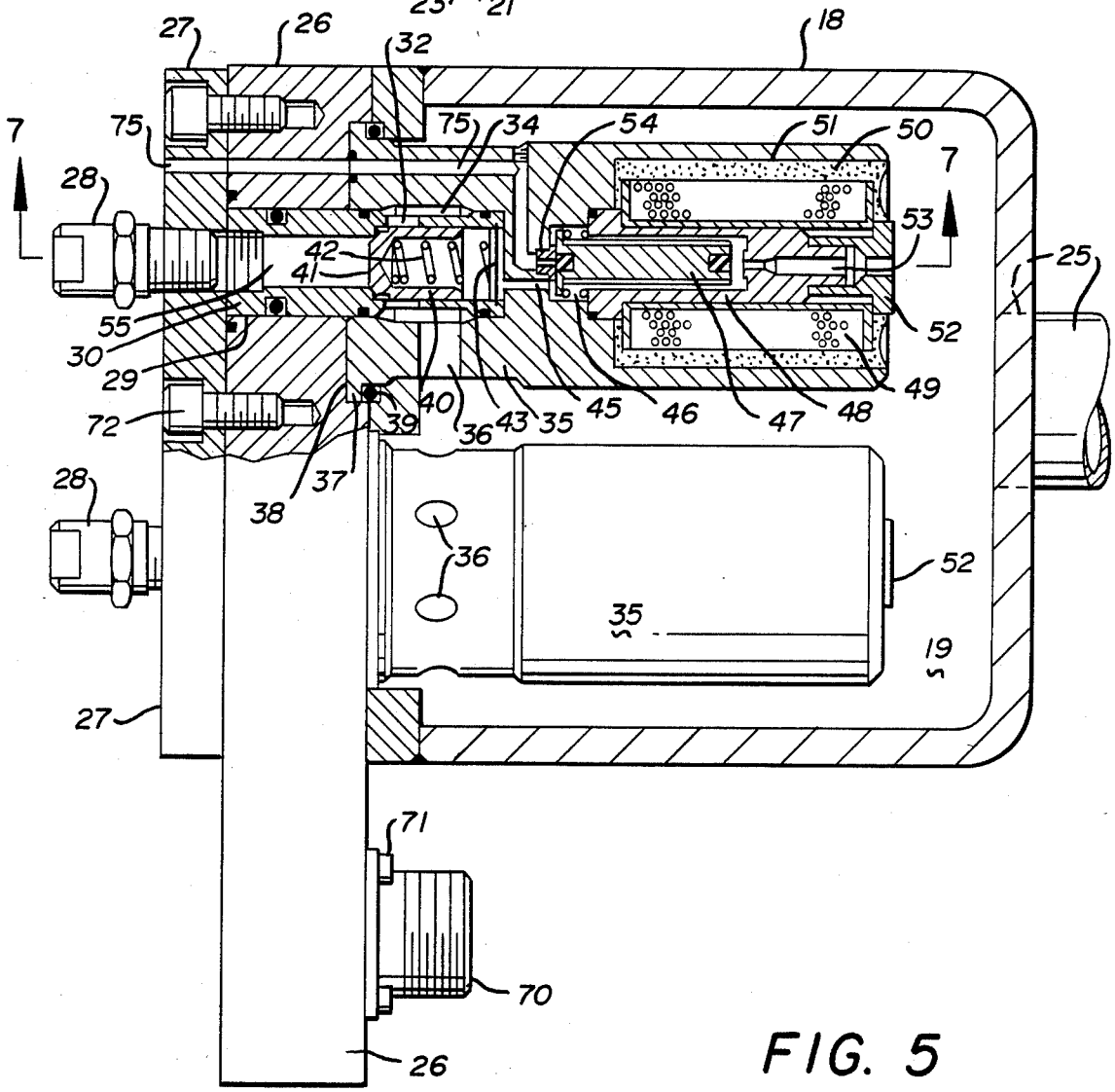
FIG. 5 is a cross sectional elevation transversely of the control valve and manifold assembly of FIG. 2 with parts broken away and parts in cross section.

Inlet ports 25, see FIG. 5, comprise means for delivering a coolant, such as kerosene thereinto and a plurality of body members 26 are sealingly attached to an open side of the housing 18 and carry nozzle plates 27, each of which carries one or more spray nozzles 28 through which coolant is selectively directed to the rolls of the rolling mill in desirable volume and spray pattern.

A horizontal section through one of the elongated housings 18 and one of the pilot operated coolant control valve assemblies secured thereto is seen in FIG. 5 of the drawings.

Figure 3:
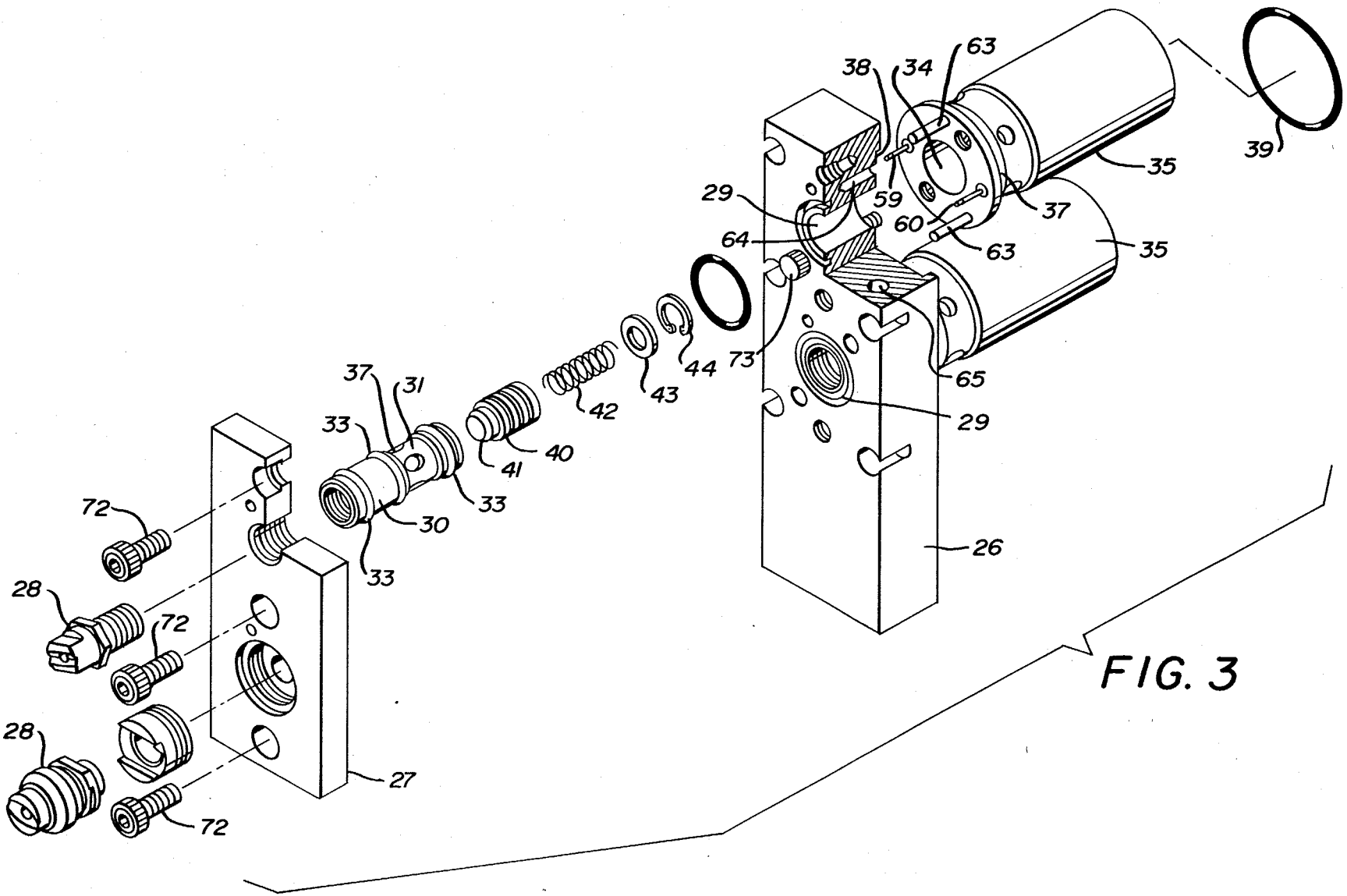
FIG. 3 is an exploded perspective elevation of one of the coolant control valves, a body member, a nozzle plate, a coolant valve body valve element for operation therein and a pair of solenoid operated pilot valves with parts broken away and parts in cross section.
Figure 4:
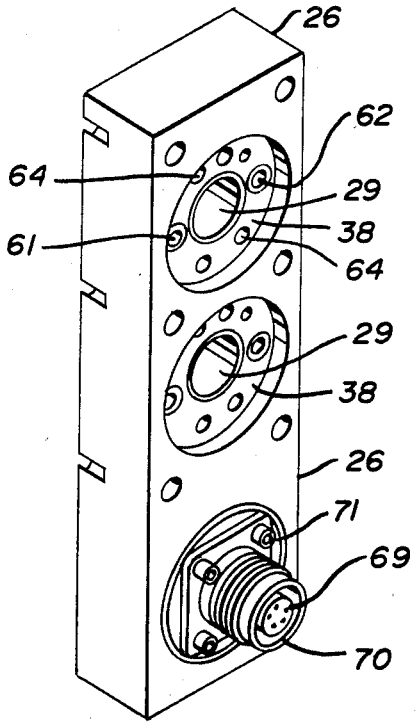
FIG. 4 is a perspective view of the reverse side of the valve body seen in FIG. 3 of the drawings.

By referring now to FIGS. 3, 4 and 5 of the drawings, it will be seen that each of the plurality of pilot operated coolant control valves is mounted in apertures 29 in each of the body members 26 and that each of the coolant control valves comprises a cylindrical valve body 30 having several openings 32 circumferentially spaced therein. Several annular seals, such as O-rings 33 are carried in annular grooves in the cylindrical valve body 30 which sealingly engage the apertures 29 in the body member 26 and a cross sectionally circular cavity 34 in each of a plurality of coil cartridge bodies 35.

By referring to FIG. 5 in particular, it will be seen that each of the coil cartridge bodies 35 has several openings 36 therein which communicate with the cross sectionally circular cavity 34 therein and each of the bodies 35 is provided with an annular flange 37 on one end which registers in an annular cavity 38 in the body member 26. Annular seals such as O-rings 39 are positioned between the annular flanges 37 of the coil cartridge bodies 35 and the open side of the elongated housing 18.

Referring again to FIGS. 3, 4 and 5 of the drawings, it will be seen that a cylindrical valve element 40 having a closed conical end 41 is movably positioned in the cylindrical valve body 30 so as to be movable therein relative to the openings 32 in the area of reduced diameter 31 of the cylindrical valve body 30. It will also be seen that the inner diameter of the cylindrical valve body 30 is increased in the area thereof in which the cylindrical valve element 40 is slidably mounted and that a portion of the closed conical end 41 of the valve element 40 is positioned in the enlarged inner area when the valve element 40 is in closed relation to the hollow interior of the cylindrical valve body 30 as best shown in FIG. 5 of the drawings. A spring 42 is positioned within the cylindrical valve body 40 and engaged against the inner surface of the closed end 41 thereof and against a centrally apertured disc 43 which is secured in one end of the cylindrical valve body 30.

By again referring to FIG. 5 of the drawings, it will be observed that a passageway 45 establishes communication between the inner end of the cross sectionally circular cavity 34 in the cartridge carrying body 35 and a pilot valve chamber 46 therein. A solenoid plunger 47 is movably disposed in a sleeve 48 which defines part of the pilot valve chamber 46 and which sleeve 48 is positioned within a solenoid coil 49 which is encapsulated by a suitable resin 50 which holds the solenoid coil 49 in an enlarged cavity 51 in the coil cartridge body 35. The sleeve 48 has a collar 52 positioned on the end thereof opposite the pilot valve chamber 46 therein and a passageway 53 in the sleeve 48 communicates with the opening defined by the collar 52 which thereby establishes communication with the interior of the elongated housing 18 forming the manifold of the device.

Still referring to FIG. 5 of the drawings, it will be seen that the plunger 47 has secondary valve elements comprising resilient seals in each of its opposite ends, one of which will engage and close the passageway 53 when the plunger 47 moves to the right responsive to energization of the coil 49. The seal in the opposite end of the plunger 47 engages and closes an opening in a pilot valve seat 54 when the coil 49 is de-energized and a spring and fluid pressure of the coolant in the elongated housing 18 moves the plunger 47 to the left as illustrated in FIG. 5 of the drawings. When this occurs, the fluid pressure extends through the pilot valve chamber 46, the passageway 45, and communicates with the interior of the cylindrical valve body 30 and the interior of the cylindrical valve element 40 therein and with the added urging of the spring 42 moves the conical end closure 41 of the valve element 40 into closed relation with the valve seat formed by the different inner diameters of the cylindrical valve body 30 thereby closing a fluid passageway 55 defined by the cylindrical valve body 30 and which passageway 55 communicates with an extension thereof in the nozzle plate 27 and the spray nozzle 28 engaged therein.

It will thus be seen that the coolant fluid in the elongated housing 18 which has been flowing through the openings 36 in the coil cartridge bodies 35 and through the interior of the cylindrical valve body 30 and the fluid passageway 55 defined thereby is instantly stopped by the overbalancing of the urging of the spring 42 against the cylindrical valve element 40 by the fluid pressure of the coolant fluid in the elongated housing 18 which extends inwardly of the passageway 53 and through the pilot valve chamber 46 around the smaller diameter plunger 47 therein and through the passageway 45 and into the interior of the cylindrical valve body 30.

Figure 6:
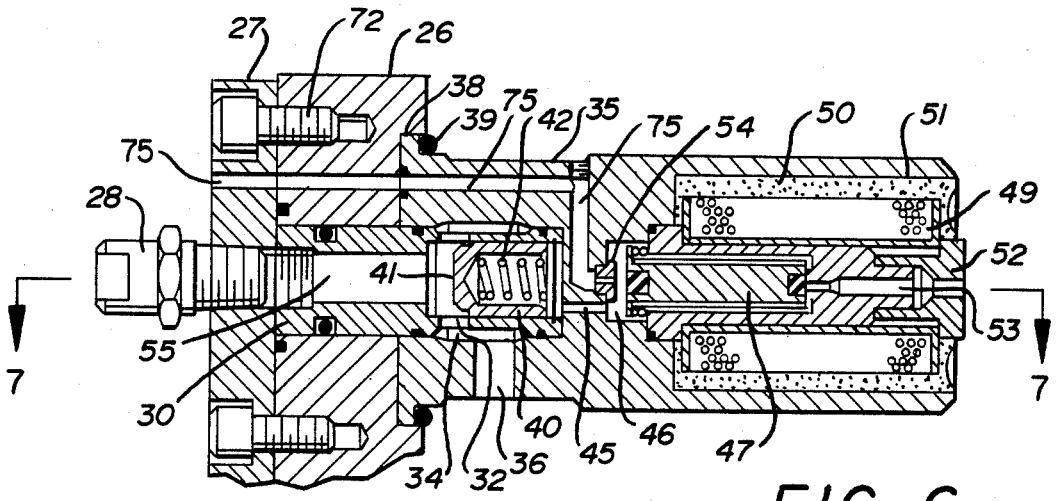
FIG. 6 is a said elevation of one of the coolant valve assemblies and operating solenoids of FIG. 5 with parts broken away and parts in cross section.

The opening of the fluid passageway comprising the openings 36 in the coil cartridge bodies 35 and the fluid passageway 55 in the cylindrical valve body 30 is equally rapid because, as best illustrated in FIG. 6 of the drawings, energization of the solenoid coil 49 moves the plunger 47 to the right closing the inner end of the fluid passageway 53 and simultaneously moving away from the pilot valve seat 54 and the opening therein which communicates with a vent passageway 75 in the coil cartridge body 35 and which vent passageway 55 extends through the body member 26 and the nozzle plate 27 to atmosphere. Thus fluid in the interior of the cylindrical valve body 30 and the interior of the cylindrical valve element 40 is vented to atmosphere by way of the pilot valve chamber 46 and the passageway 45 and the over-balancing of the spring 42 ends. The pressure of the coolant fluid in the elongated housing 18 can thus extend through the openings 36 into the cross sectionally circular cavity 34 and through the openings 32 where it will engage the conical closed end 41 of the valve element 40 and move the same to the right as seen in FIG. 6 to full open position and against the urging of the spring 42. The coolant fluid thus instantly flows through the openings 36 and 32 and into the passageway 55 defined by the cylindrical valve body 30 and through the spray nozzles 28 engaged in the extension thereof.

The circuit for energizing the solenoid coil 49 is carried by conductors 57 and 58 positioned in the cavity 51 and extensions thereof and extend from the coil 49 to terminal pins 59 and 60 as seen in FIG. 3 of the drawings and which pins 59 and 60 project from the base of the coil cartridge body 35 inwardly of the annular flange 37 thereon. The cavities 51 and the passageways in the coil cartridge bodies 35 through which conductors extend to the terminal pins 58 and 59 are filled with an epoxy resin used for encapsulating the conductors 57 and 58 and the solenoid coil 49 and as heretofore referred to and indicated in FIGS. 5 and 6 of the drawings by the reference numerals 50.

By referring to FIG. 4 of the drawings, it will be seen that receptacles 61 and 62 are formed in the recessed area 38 of the body members 26 around the apertures 29 for the reception of the terminal pins 59 and 60 and by again referring to FIG. 3 of the drawings, it will be seen that each of the coil cartridge bodies 35 and the base thereof has at least a pair of alignment pins 63 which project from the base of the coil cartridge body 35 in spaced relation to the terminal pins 59 and 60 and are arranged to register with matching sockets 64 in the recessed area 38 of the body member 26 as seen in FIG. 4 of the drawings. This construction prevents rotation of the coil cartridge bodies 35 with respect to the body members 26 and insures satisfactory electrical contact between the terminal pins 59 and 60 and the receptacles 61 and 62.

Figure 7:
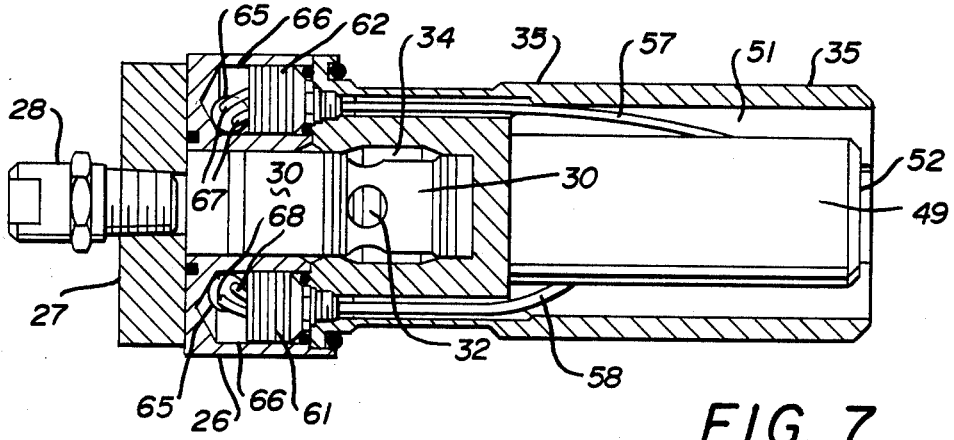
FIG. 7 is a side elevation of one of the coolant valves of FIG. 5 with parts broken away and parts in cross section and illustrating the wiring for operating the solenoid pilot valve thereof.

By referring to FIG. 7 of the drawings, it will be seen that the body member 26 is provided with two vertical bores 65 which extend upwardly therein from the bottom thereof and communicate with horizontal bores 66 in which the electrical receptacles 61 and 62 are positioned. Conductors 67 and 68 extend from the receptacles 61 and 62 into the vertical bores 65 and downwardly therethrough to points inwardly of the lower end of the body member 26 and as illustrated in FIG. 4 connect with an electrical connection plug 69 which is positioned in a cylindrical body 70 having exteriorly arranged threads for the reception and engagement of a matching electrical connection plug (not shown). The electrical connection plug 69 and its mounting are secured to the body member 26 by fasteners 71.

In completed assembly, the electrical connection plugs 69 in their cylindrical bodies extend from the back surfaces of the body members 26 and below the elongated horizontal housing 18. A wiring harness (not shown) carrying a plurality of the matching electrical connection plugs enables electrical connection to be made from a control means (not shown) to each of the electrical connection plugs 69 on each of the body members 26 thus providing for the simultaneous control of the pilot operated coolant control valves through which the coolant is delivered to the rolls of the rolling mill.

The body members of the device of the invention are preferably stainless steel and as hereinbefore described, it will be recognized that the actual coolant controlling valves are formed as readily replaceable poppet cartridges which can be readily removed and inspected and/or replaced if necessary by simply removing the nozzle plate 27 which is attached to the body member 26 by fastener 72.

The coil cartridge bodies 35 are similarly attached to the body member 26 by fasteners 73.

The solenoid coils being sealed and held in place by encapsulation in the epoxy resin are protected from damage which might otherwise occur from the coolant in which the coil cartridge bodies 35 are submerged. The solenoid coils 49 are designed to operate at 24 volts DC and draw a maximum of 0.30 amps. The plungers 47 and the coils 49 are so designed that the same are fully operational at 85% of the indicated voltage and thus evidence small power requirements which substantially improve the device, both with respect to automatic and manual imput signals for operation.

Those skilled in the art of rolling mill reduction of metals will be familiar with the fact that the continuous direction of a suitable coolant such as kerosene as specified herein on the work and back up rolls of the rolling mill, in effect controls the temperature of the work rolls and thereby the thickness of the metal being rolled. A desirable coolant temperature easily maintained with the present system is between 90° F. and 160° F. with coolant pressure supplied the plurality of spray nozzles 28 at varying, desired pressures between 10 and 100 p.s.i. The nozzles 28 are preferably arranged for indexing at 15° from a transverse center line so as to insure complete coverage of the work and backup rolls of the rolling mill on which the device is used.

A typical pilot operated coolant valve assembly as disclosed herein will operate successfully for several million cycles and consistently avoid leakage when in closed or non-operating status.

It will thus be seen that substantially improved pilot operated coolant control valves in manifold assembly have been disclosed and that although but one embodiment of the present invention has been illustrated and described, it will be apparent to those skilled in the art that various changes and modifications may be made therein without departing from the spirit of the invention or from the scope of the appended claims and having thus described my invention what I claim is:

1. In pilot operated coolant control valves in a manifold assembly for supplying a coolant and apertured body members closing said manifold, the improvement comprising forming said coolant control valves as removable cartridges positioned in registry with said apertures in said body members, each of said cartridges consisting of a cylindrical valve body apertured inwardly of its ends, a valve seat in said valve body, a valve element movably disposed in said valve body, means urging said valve element toward said valve seat, a coil cartridge body engaging said cylindrical valve body and defining a cavity for receiving coolant from said manifold, a portion of said valve body and said valve element disposed in said cavity, openings in said coil cartridge body communicating with said cavity and said manifold, a solenoid plunger in a chamber axially of said coil cartridge body, secondary valve elements on the ends of said solenoid plunger for registry with oppositely disposed passageways communicating with said chamber and said manifold and the atmosphere respectively, a solenoid coil in said coil cartridge body for moving said solenoid plunger when energized and one of said secondary valve elements against said passageway communicating with said manifold to maintain said valve element in open position and whereby coolant in said cavity moves said solenoid plunger, when said solenoid coil is de-energized, against the passageway communicating with the atmosphere to maintain said valve element in closed position and electrical conductors in connection with said solenoid coil for energizing the same.

2. The improvement in pilot operated coolant control valves set forth in claim 1 and wherein spray means are in communication with said apertures in said body members.

3. The improvement in pilot operated coolant control valves set forth in claim 1 and wherein said passageway in said coil cartridge bodies communicating with the atmosphere continues through said body members.

4. The improvement in pilot operated coolant control valves set forth in claim 1 and wherein electrical conductors to hold the same in connection with said solenoid coils extend through passageways in said coil cartridge bodies, terminal pins extending outwardly of one end of said coil cartridge bodies, electrical receptacles in said body members positioned for engagement with said terminal pins, said electrical conductors engaging said terminal pins and epoxy resin encapsulating said solenoid coils and conductors in said coil cartridge bodies.

5. The improvement in pilot operated coolant control valves set forth in claim 1 and wherein electrical conductors in connection with said solenoid coils extend through passageways in said coil cartridge bodies, terminal pins extending outwardly of one end of said coil cartridge bodies, electrical receptacles in said body members positioned for engagement with said terminal pins, said electrical conductors engaging said terminal pins, passageways in said body members, second electrical conductors in said passageways engaging said electrical receptacles, said body members extending outwardly of said manifolds and electrical connection plugs on said body members, said second electrical conductors in said passageways in said body members establishing electrical connection with said electrical connection plugs and means for electrically interconnecting each of said electrical connection plugs whereby said solenoids in said coil cartridge bodies may be simultaneously energized and de-energized by controlling an electrical circuit through said interconnecting electrical connection means.

6. The improvement in pilot operated coolant control valves set forth in claim 1 and wherein said means urging said valve element toward said valve seat consists of a spring in said cylindrical valve body.

* * * * *